US011591851B1

(12) United States Patent
Chou

(10) Patent No.: US 11,591,851 B1
(45) Date of Patent: Feb. 28, 2023

(54) FREE HANGING SAFETY BEAD CHAIN TENSION DEVICE

(71) Applicants: Tser Wen Chou, Yorba Linda, CA (US); Mason Chou, Irvine, CA (US)

(72) Inventor: Tser Wen Chou, Yorba Linda, CA (US)

(73) Assignees: Tser Wen Chou, Yorba Linda, CA (US); Mason Chou, Irvine, CA (US)

( * ) Notice: Subject to any disclaimer, the term of this patent is extended or adjusted under 35 U.S.C. 154(b) by 0 days.

(21) Appl. No.: 17/842,353

(22) Filed: Jun. 16, 2022

(51) Int. Cl.
*E06B 9/78* (2006.01)
*E06B 9/42* (2006.01)

(52) U.S. Cl.
CPC ..... *E06B 9/78* (2013.01); *E06B 9/42* (2013.01); *E06B 2009/785* (2013.01)

(58) Field of Classification Search
CPC ..... E06B 9/78; E06B 2009/785; E06B 9/42; E06B 9/50; E06B 9/56; E06B 9/324; E06B 9/326; E06B 2009/3265
See application file for complete search history.

(56) References Cited

U.S. PATENT DOCUMENTS

2012/0160431 A1* 6/2012 Cannaverde ..... E06B 9/326 160/340
2019/0390514 A1* 12/2019 Marocco ..... F16H 7/18

FOREIGN PATENT DOCUMENTS

| | | | | | |
|---|---|---|---|---|---|
| CN | 202926186 | U | * | 5/2013 | ..... E06B 9/42 |
| DE | 202010017956 | U1 | * | 5/2013 | ..... E06B 9/322 |
| KR | 20110106248 | A | * | 9/2011 | |
| KR | 20130003780 | | * | 1/2013 | ..... E06B 9/42 |
| KR | 101352533 | B1 | * | 1/2014 | |
| KR | 20140111596 | A | * | 2/2014 | ..... E06B 9/322 |
| KR | 101400243 | B1 | * | 5/2014 | ..... E06B 9/42 |
| KR | 20140106100 | A | * | 9/2014 | ..... E06B 9/42 |
| WO | WO-2011134022 | A1 | * | 11/2011 | ..... E06B 9/326 |

* cited by examiner

*Primary Examiner* — Daniel P Cahn
*Assistant Examiner* — Jeremy C Ramsey
(74) *Attorney, Agent, or Firm* — Guice Patents PLLC

(57) ABSTRACT

A free hanging safety bead chain tension device includes a clutch, a bead chain for controlling ascending/descending of a roller shade, a tension rod and more than one restriction seats. The bead chain is connected with the tension rod and the restriction seats are disposed on the rod body of the tension rod. Each restriction seat has one or more restriction tunnels for locating the bead chain adjacent to the tension rod. When pulling the bead chain to control the ascending/descending of the roller shade, the bead chain is positioned by the tension rod and the restriction seats. Accordingly, not only the bead chain can be still smoothly pulled, but also the bead chain is prevented from being pulled out by a space sufficient to twist around a neck. Therefore, a child is prevented from pulling the bead chain to twist the bead chain around the child's neck so that a safety effect is achieved.

7 Claims, 14 Drawing Sheets

FREE HANGING SAFETY BEAD CHAIN TENSION DEVICE

BACKGROUND OF THE INVENTION

1. Field of the Invention

The present invention relates generally to a free hanging bead chain child safety device, and more particularly to a safety bead chain child safety device, which can prevent a child from pulling the bead chain to twist the bead chain around the child's neck.

2. Description of the Related Art

A conventional roller shade often employs a clutch to control ascending/descending of the roller shade fabric. The clutch is connected with a roller shade tube. When pulling the bead chain, the clutch is rotated to drive and rotate the roller shade tube so as to lift or lower the roller shade fabric. When the clutch stops driving and moving the roller shade fabric, the bead chain of the clutch naturally suspends from one side of a window to a lower edge of the window without being secured. The unsecured bead chain allows a space sufficient for the bead chain to twist around a neck. As a result, it is easy for a child to pull the bead chain and twist the bead chain around the child's neck to cause fatal injury. Therefore, in use of the conventional roller shade, the suspending bead chain may lead to unexpected danger. In order to solve the problem that the conventional bead chain is not secured so that a child may twist the bead chain around the child's neck to cause fatal injury, a bead chain tension device has been developed. Such bead chain tension device has a securing unit disposed at the tail end of the suspending bead chain. The securing unit is fixed on the wall to place and tighten the bead chain loop and prevent a child from pulling the bead chain and twisting the bead chain around the child's neck. Such securing unit can tighten the bead chain. However, the bead chain exposed to outer side still has a gap so that a sufficiently large dangerous space still exists and may allow a child to pull the bead chain and twist the bead chain around the child's neck. Moreover, it often takes place that the securing unit is not installed as required. In this case, the bead chain will still threaten the life of the child. Therefore, the conventional bead chain securing device is not an optimal design.

SUMMARY OF THE INVENTION

It is therefore a primary object of the present invention to provide a free hanging safety bead chain tension device, which can effectively prevent a child from pulling the bead chain to twist the bead chain around the child's neck so as to enhance safety effect. The free hanging safety bead chain tension device includes a clutch, a bead chain for controlling ascending/descending of a roller shade, a tension rod and more than one restriction seats. The bead chain is connected with the tension rod and the restriction seats are secured on the rod body of the tension rod. Each restriction seat has one or more restriction tunnels. The bead chain is passed through the restriction tunnels and located adjacent to the tension rod. When pulling the bead chain to control the ascending/descending of the roller shade, the bead chain is located by the tension rod and the restriction seats. Accordingly, the bead chain is prevented from being pulled out by a space sufficient to twist around a neck. Therefore, a child is prevented from pulling the bead chain to twist the bead chain around the child's neck so that the safety of the bead chain is enhanced.

It is a further object of the present invention to provide the above free hanging safety bead chain tension device, which can effectively prevent a child from pulling the bead chain to twist the bead chain around the child's neck so as to enhance safety effect. Furthermore, the free hanging safety bead chain tension device facilitates and speeds the operation of the bead chain. The ring member at the upper end of the tension rod is connected on a hanging hook. The hanging hook is then hung on a bracket tab of a bracket. When the bracket is assembled with the clutch, the hanging hook is positioned in the space between the bracket and the clutch and concealed. In this case, the tension rod suspends under the clutch and sways on the hanging hook. Accordingly, an operator can more conveniently operate the bead chain by more angles so as to facilitate and speed the operation of the bead chain.

To achieve the above and other objects, the free hanging safety bead chain tension device of the present invention includes a clutch, a tension rod and more than one restriction seats. The clutch is drivable by a bead chain to drive and rotate a roller shade tube so as to control ascending/descending of the roller shade. The tension rod is an elongated rod body formed with a hollow central passage. An upper ring member and a lower ring member are respectively securely plugged-in upper end and lower end of the passage. The lower ring member is larger than the upper ring member. By means of the upper and lower ring members, the tension rod is connected between the clutch and the bottommost end of the bead chain so it sways. The restriction seats are secured on the rod body of the tension rod. The number and length of the restriction seats are properly varied with the size of the window. An internal passage is formed in the restriction seats for the tension rod to pass through. After the tension rod is passed through the passage, the tension rod and the restriction seats are secured in a proper position by means of screws. By means of the one or more internal tunnels, the bead chain is passed through the restriction seats, whereby the restriction seats limit the position of the bead chain. When pulling the bead chain to control the ascending/descending of the roller shade, the bead chain is located by the tension rod and the restriction seats. Accordingly, the bead chain is prevented from being pulled out by a space sufficient to twist around a neck. Therefore, a child is prevented from pulling the bead chain to twist the bead chain around the child's neck so that a safety effect is achieved.

The first technical core of the present invention lies in that the tension rod is disposed between the clutch and the bead chain so that the gap space between the two downward suspending bead chains is eliminated and no excessive space remains. In this case, the bead chain cannot be pulled out by a space sufficient to twist around a neck. Therefore, a child is prevented from pulling the bead chain to twist the bead chain around the child's neck so that the danger is avoided. Moreover, due to the limitation of the ring members plugged in the upper and lower ends of the tension rod and the restriction tunnels of the restriction seats, the bead chain can only move in the path of the tension rod and the restriction seats without affecting the operation of the bead chain. Therefore, there is no space for a child to pull out the bead chain.

The second technical core of the present invention lies in that the tension rod is positioned beside the bead chains and the ring member at the upper end of tension rod is connected on a hanging hook. The hanging hook is hooked and hung on the bracket tab of the bracket. When the bracket is assembled with the clutch, the hanging hook is securely sandwiched between the clutch and the bracket and concealed. Therefore, the ring member hung on the hanging hook serves as a connection fulcrum for the tension rod, whereby the tension rod may sway as necessary. Accordingly, an operator can more conveniently pull the bead chain by more angles so as to facilitate and speed the operation of the bead chain.

In the present invention, in order to solve the stop position problem of the roller shade, a stop bead sheath with larger diameter is fitted around a bead body of the bead chain. The stop bead sheath is fitted around a corresponding bead body in accordance with a predetermined stop position of the roller shade. When the stop bead ascends to the clutch, it cannot be further lifted. The roller shade is controlled and located in a predetermined upper position or a predetermined lower position.

In addition, in the present invention, in order to permit an endless bead chain or a connected bead chain to pass through the restriction seat, two slots are especially formed on the junction wall face between the passage and the restriction tunnels of the restriction seat. Therefore, the endless bead chain or the connected bead chain can pass through the slots to directly pass through the restriction seat.

The present invention can be best understood through the following description and accompanying drawings, wherein:

DETAILED DESCRIPTION OF THE PREFERRED EMBODIMENTS

Figure 1:
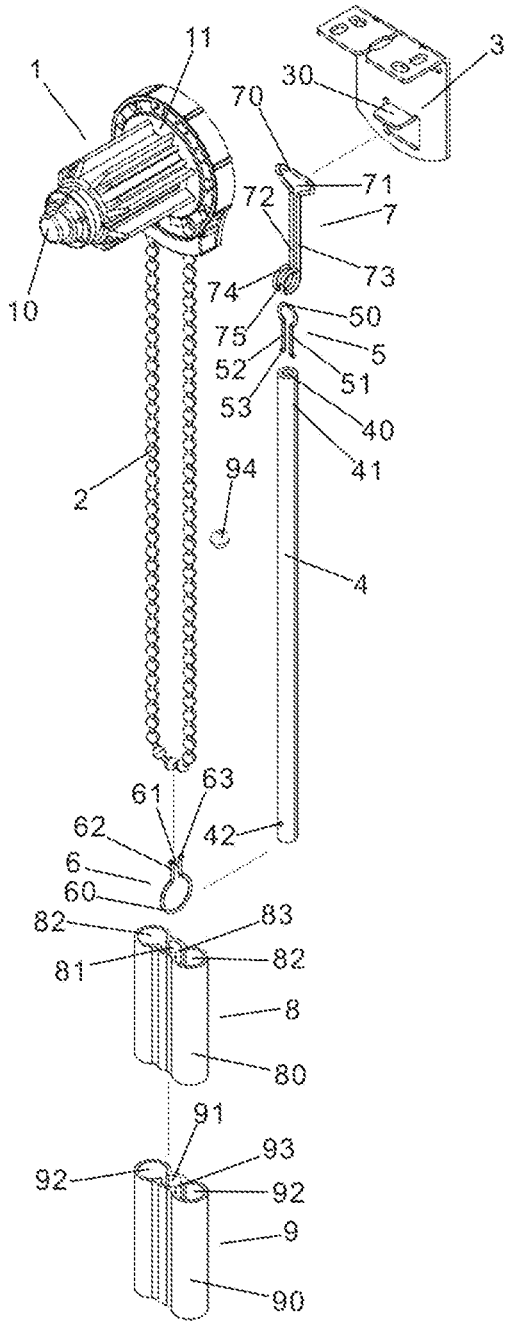
FIG. 1 is a perspective exploded view of the present invention.
Figure 2:
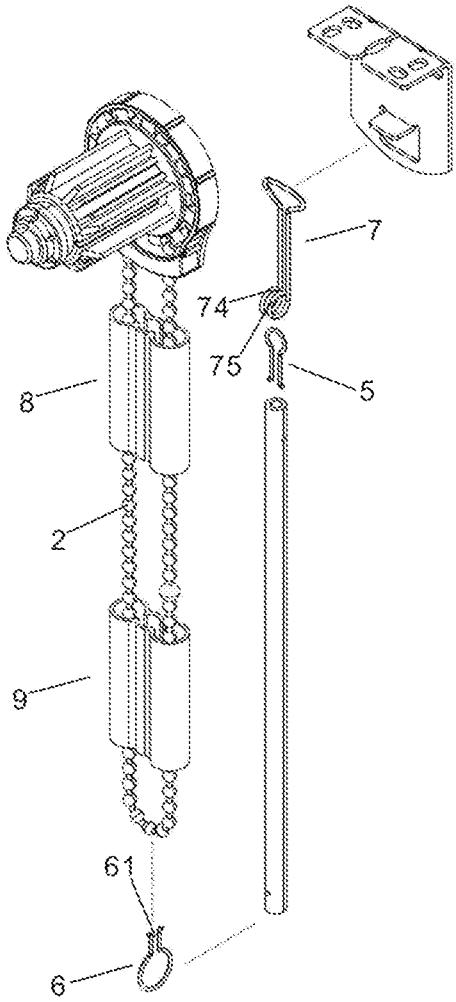
FIG. 2 is a perspective assembled view of the restriction seats of the present invention.

Please refer to FIG. 1. The present invention mainly includes a clutch 1, a bead chain 2, a bracket 3, a tension rod 4, two ring members 5, 6, a hanging hook 7 and more than one restriction seats 8, 9 (there are two in the drawings). A clutch spindle 10 protrudes from a front end of the clutch bracket 1. The clutch spindle 10 is connectable with a roller shade tube for driving the roller shade tube to rotate. A bead chain sprocket 11 is secured to a rear end of the clutch spindle 10 for mounting the bead chain 2 on the bead chain sprocket 11. By means of pulling the bead chain 2, the roller shade tube can be driven to rotate so as to control ascending/descending of the roller shade. The bracket 3 is connected with a rear side of the clutch 1. A bracket tab 30 protrudes from a support face of the bracket 3 for connecting the bracket 3 with the clutch 1. An upper end of the tension rod 4 is hung on the bracket 3. A lower end of the tension rod 4 is connected with a bottommost end of the bead chain 2, whereby the tension rod 4 is disposed between two suspending bead chains 2. The tension rod 4 is formed with a hollow central passage 40 extending from the top end to the bottom end of the tension rod 4. Two sides of the upper and lower ends of the tension rod 4 are respectively formed with engagement holes 41, 42 to engage with the passage 40. The two ring members 5, 6 with different sizes are plugged into the upper and lower ends of the passage 40 and engaged in the engagement holes 41, 42 to assemble with the tension rod 4. Each of the two ring members 5, 6 has a ring body 50, 60. Each of the ring body 50, 60 is formed with a split 51, 61. Two securing bars 52, 62 extend from the splits 51, 61. A hook body 53, 63 is disposed at a free end of each of the securing bars 52, 62. When the securing bars 52, 62 of the ring members 5, 6 are plugged into the passage 40 of the center rod 4, the two securing bars 52, 62 are first inward contracted. When the securing bars 52, 62 reach the engagement holes 41, 42, the securing bars 52, 62 expand outward so that the hook bodies 53, 63 at the free ends of the securing bars 52, 62 engage into the engagement holes 41, 42 to secure the ring members 5, 6 to the locating bar 4. The hanging hook 7 is latched with the ring body 50 of the ring member 5. A fitting ring 70 is disposed at an upper end of the hanging hook 7. The fitting ring 70 is fitted on the bracket tab 30 of the bracket 3. When the bracket 3 is assembled with the clutch 1, the fitting ring 70 of the hanging hook 7 is sandwiched between the bracket 3 and the clutch 1 and concealed. The fitting ring 70 is also formed with a split 71. Two extending bars 72, 73 extend from the split 71. Two ring bodies 74, 75 are respectively formed at free ends of the extending bars 72, 73. The ring body 50 of the ring member 5 is latched with the ring bodies 74, 75, whereby the tension rod 4 suspends under the clutch 1. Each of the restriction seats 8, 9 mainly has a seat body 80, 90. A hollow passage 81, 91 is formed at a center of each of the restriction seats 8, 9 for the center rod 4 to pass through. Two hollow restriction tunnels 82, 92 are further formed on two sides of the passage 81, 91 of each of the restriction seats 8, 9 for the bead chain 2 to pass through. A slot 83, 93 is formed at the junction between the hollow passage 81, 91 and the hollow restriction tunnel 82, 92. Through the slots 83, 93, an endless bead chain or a connected bead chain can directly pass through the restriction seats 8, 9, whereby the restriction seats 8, 9 restrict the bead chain 2 to be positioned outside the center rod 4. In addition, in order to solve the positioning problem of the roller shade, a locating stop bead 94 is fitted around a bead body of the bead chain 2 to control and restrict the roller shade to be located in a predetermined upper position or a predetermined lower position.

Figure 3:
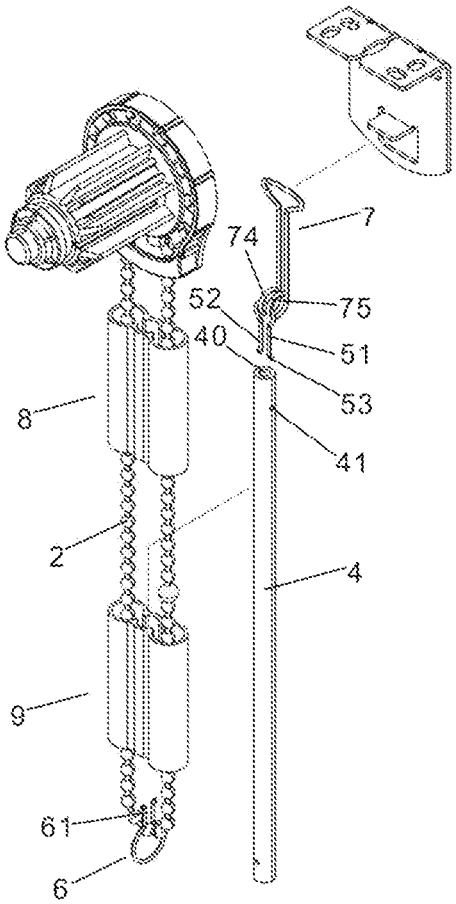
FIG. 3 is a perspective view of the present invention, showing the installation of the ring members of the present invention.
Figure 4:
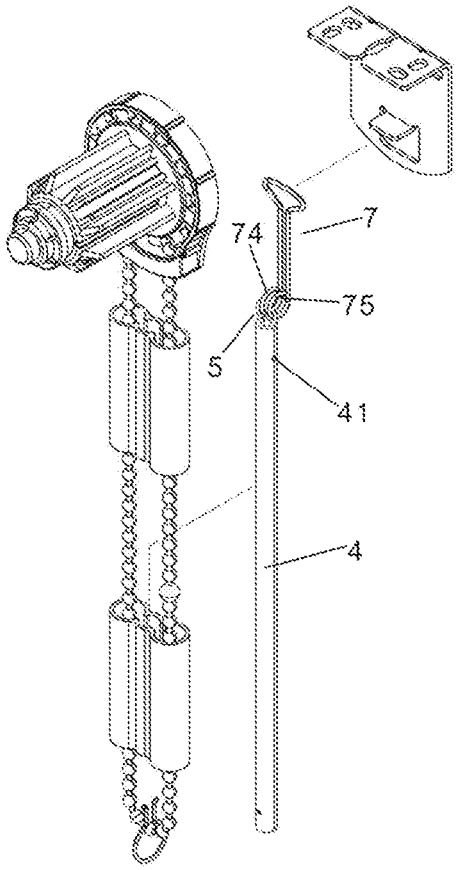
FIG. 4 is a perspective view of the present invention, showing the installation of the hanging hook of the present invention.
Figure 5:
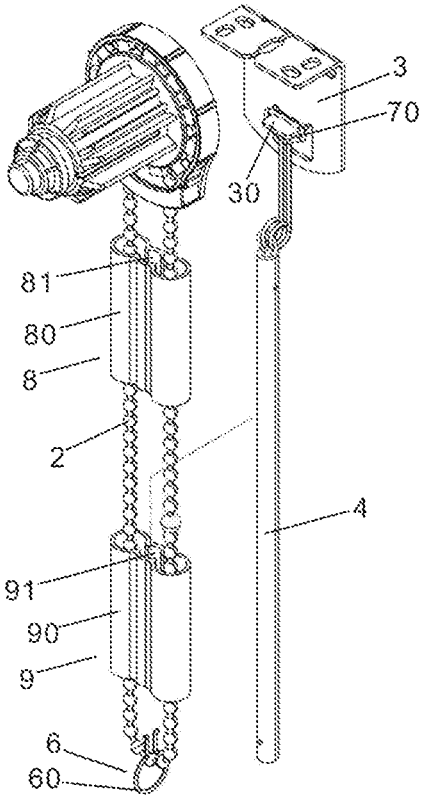
FIG. 5 is a perspective view of the present invention, showing that the installation of the ring members is completed.
Figure 6:
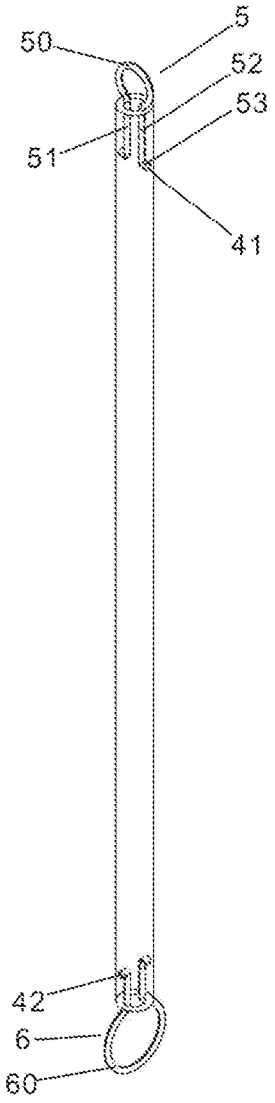
FIG. 6 is a perspective assembled view of the tension rod of the present invention.
Figure 7:
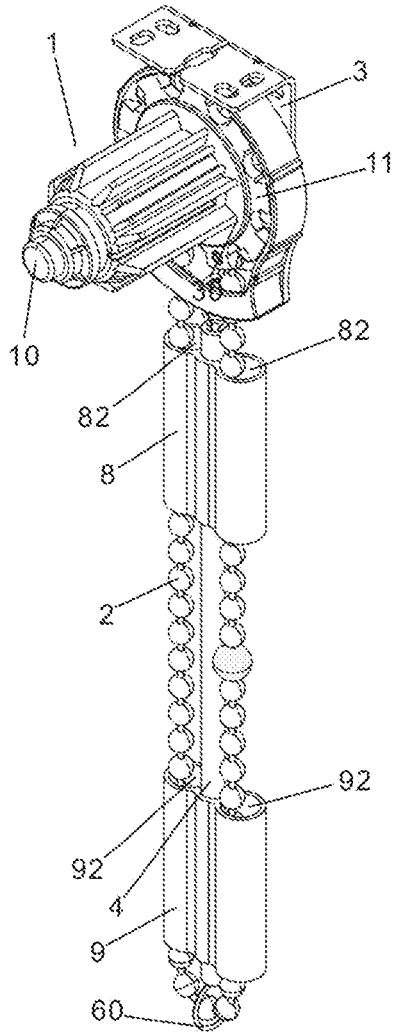
FIG. 7 is a perspective assembled view of the present invention.
Figure 8:
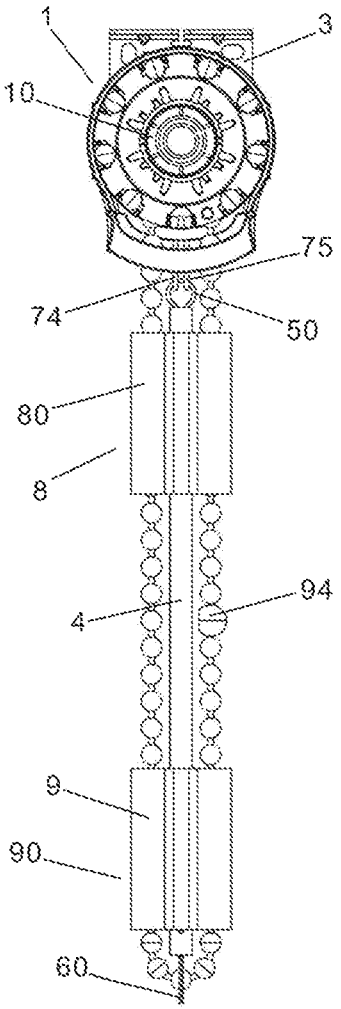
FIG. 8 is a plane assembled view of the present invention.

With respect to the assembling procedure of the present invention, please refer to FIGS. 2 to 6. First, the bead chain 2 is passed through and fitted into the restriction seats 8, 9. Then the ring member 5 at the upper end and the ring bodies 74, 75 at the lower end of the hanging hook 7 are latched with each other. The bottommost end of the bead chain 2 is passed through the split 61 of the ring member 6 at the lower end (as shown in FIG. 3). Then the two securing bars 52 of the ring member 5 at the upper end are plugged into the top end of the passage 40 of the center rod 4. The hook bodies 53 at the free ends of the securing bars 52 are engaged into the engagement holes 41 of the locating holes 41 to secure the ring member 5 to the center rod 4 (as shown in FIGS. 4 and 6). After the ring member 5 is secured to the top end of the center rod 4, the fitting ring 70 at the upper end of the hanging hook 7 is fitted onto the protruding bracket tab 30 of the securing bracket 3 so as to connect the hanging hook 7 with the bracket 3. Then the securing bracket 3 is assembled with the clutch 1 (as shown in FIG. 5). Thereafter, the center rod 4 is inserted into the passages 81, 91 of the hollow restriction seats 8, 9 from upper side to lower side, whereby the larger ring member 6 at the bottom end of the passage 40 of the center rod 4 is latched and assembled with the center rod 4. The bead chain 2 is restricted to be positioned within ring body 60 of the ring member 6. After the above components are assembled with each other, the safety bead chain tension device of the present invention is achieved (as shown in FIGS. 7 and 8).

Figure 9:
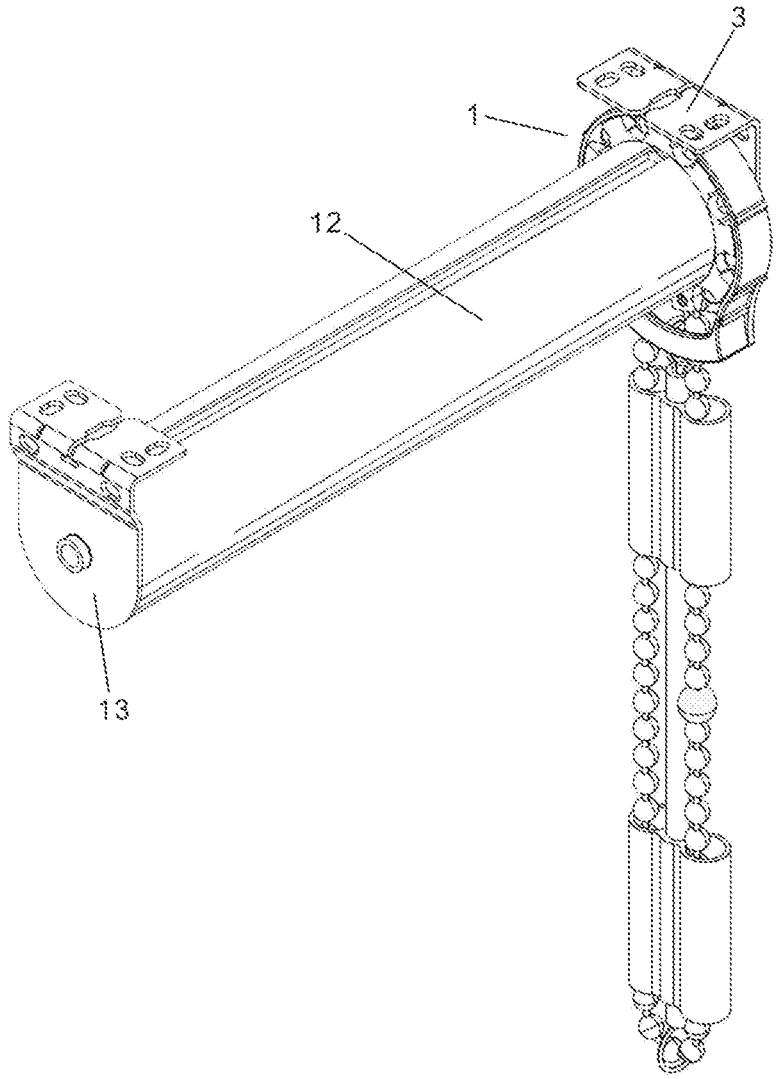
FIG. 9 is a perspective view of the present invention, showing that the installation of the roller shade tube is completed.
Figure 10:
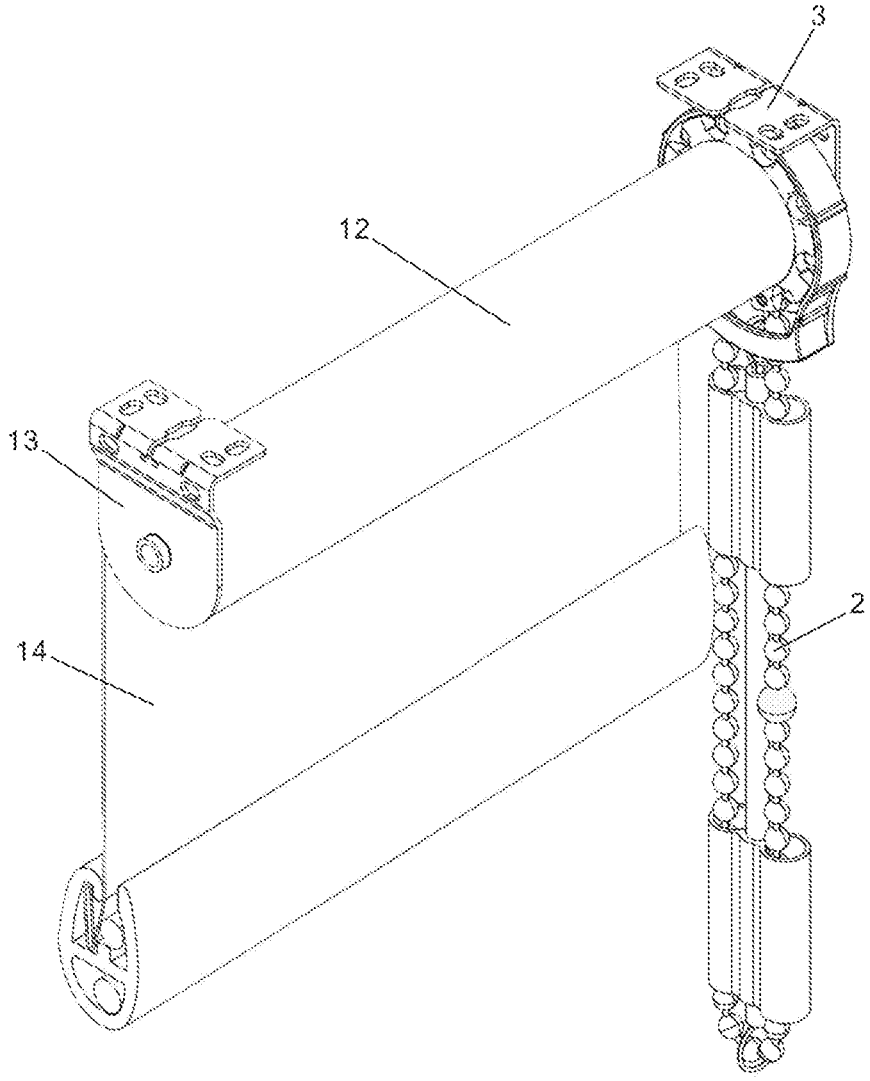
FIG. 10 is a perspective view of the present invention, showing the installation of the roller shade of the present invention.
Figure 11:
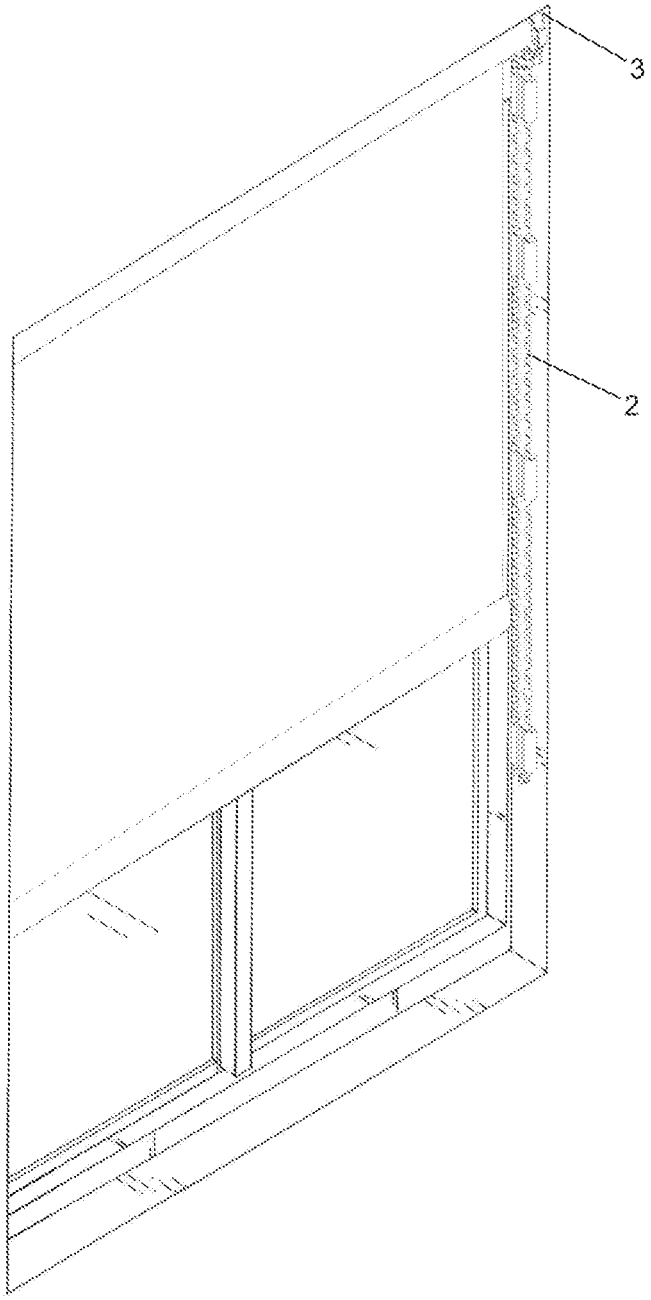
FIG. 11 is a perspective view of the present invention, showing that the roller shade of the present invention is installed inside a window.
Figure 12:
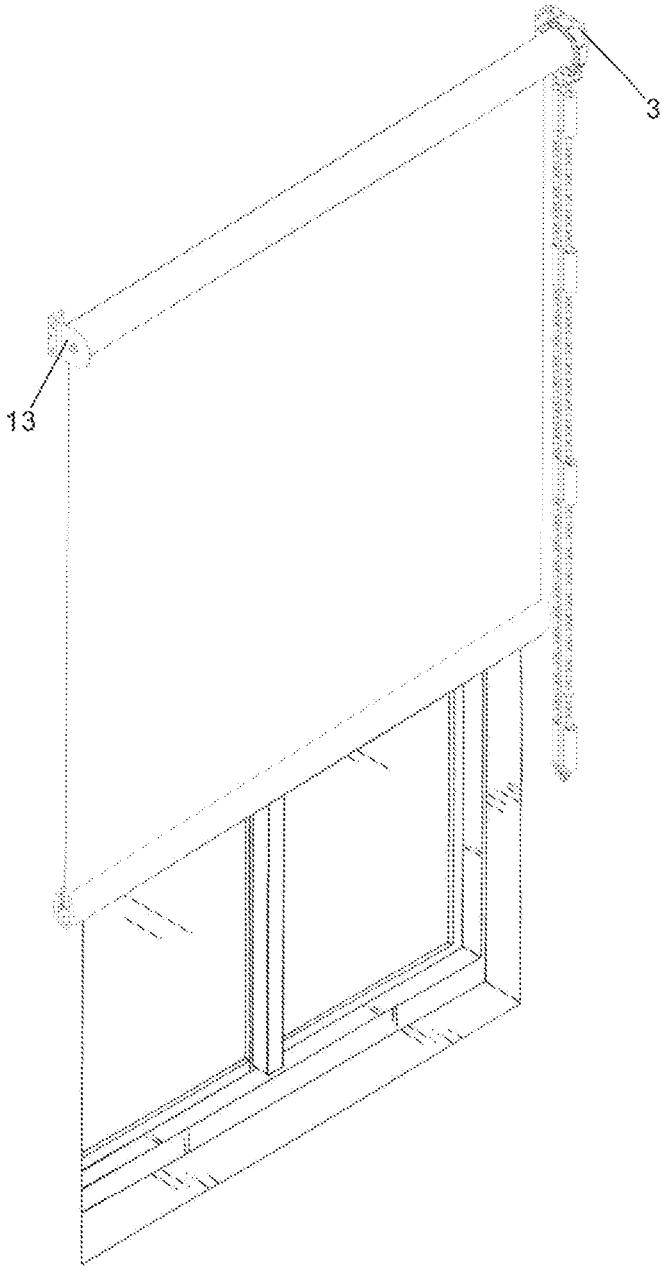
FIG. 12 is a perspective view of the present invention, showing that the roller shade of the present invention is installed outside the window.

When the safety bead chain tension device of the present invention is applied to the roller shade, the clutch spindle 10 protruding from the clutch 1 is fitted into the roller shade tube 12 (as shown in FIG. 9). The other end of the roller shade tube 12 is further connected with a mounting bracket 13. A roller shade fabric 14 is secured onto the tube body of the roller shade tube 12 (as shown in FIG. 10) to complete the roller shade device. Thereafter, by means of the bracket 3 and the mounting bracket 13, the roller shade device is mounted inside a window (as shown in FIGS. 10 and 11) or outside the window (as shown in FIG. 12) to achieve roller shade effect.

Figure 13:
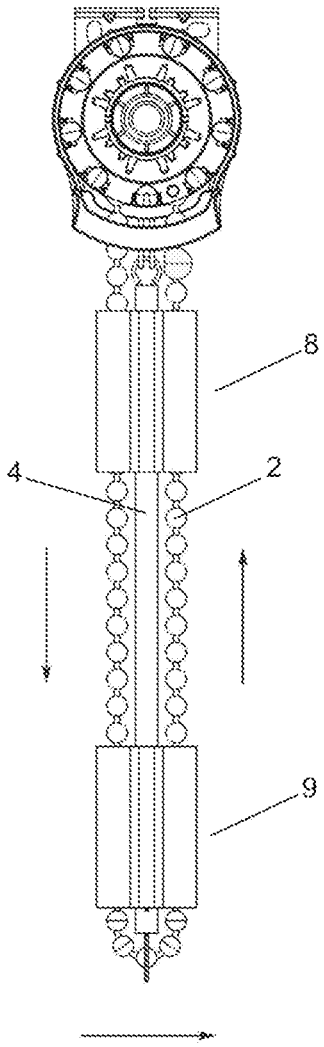
FIG. 13 is a plane view of the present invention, showing that the bead chain is pulled.
Figure 14:
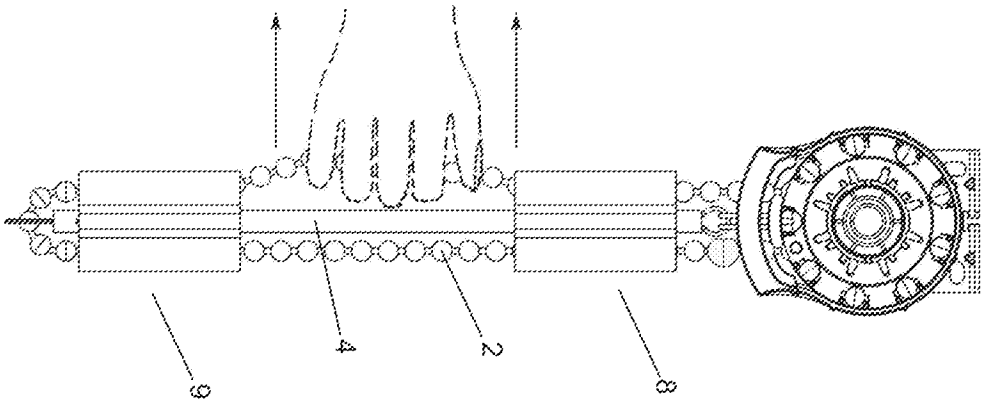
FIG. 14 is a plane view of the present invention, showing that the bead chain is pulled and restricted by the tension rod and the restriction seats of the present invention.

When it is desired to pull the bead chain 2 to control ascending/descending of the roller shade (as shown in FIG. 13), the bead chain 2 is restricted by the center rod 4 and the restriction seats 8, 9 to be positioned outside the center rod 4. Therefore, the bead chain 2 is prevented from being pulled out by a space sufficient to twist around a child's neck (as shown in FIG. 14). Accordingly, the safety bead chain locating device of the present invention can prevent a child from pulling the bead chain 2 to twist the bead chain 2 around the neck. Therefore, the safety of the bead chain 2 is enhanced.

The present invention has an additional advantage over the previous tension devices that the previous tension devices fail because end users don't want them mounted and marring their walls and molding. The free hanging device of the present invention will not mar walls or molding and comes as an assembled part of the shade eliminating the shortcoming and failures of the previous devices.

The above embodiments are only used to illustrate the present invention, not intended to limit the scope thereof. Many modifications of the above embodiments can be made without departing from the spirit of the present invention.

What is claimed is:

1. A free hanging safety bead chain tension device comprising a clutch, a tension rod, more than one restriction seat, and a bead chain, the clutch serving to control ascending and descending of a roller shade fabric, the tension rod being an elongated rod body formed with a central passage, an upper ring member and a lower ring member being respectively plugged in an upper end and a lower end of the central passage, the upper and lower ring members being respectively connected with the clutch and the bead chain, whereby the tension rod is disposed between the clutch and the bead chain, a respective seat passage being formed within each of the more than one restriction seat for the tension rod to pass through, after the tension rod is passed through each respective seat passage, the tension rod and the more than one restriction seat being securely connected, more than one restriction tunnel being further formed in each of the more than one restriction seat, the bead chain passing through each said more than one restriction tunnel and located adjacent to the tension rod, wherein the bead chain controls the ascending and descending of the roller shade, a position of the bead chain being restricted by the tension rod and each of the more than one restriction seat; wherein each of the upper ring member and the lower ring member is formed with a respective ring body, one end of each respective ring body being formed with a split, wherein two securing bars extend from the split, and two hook bodies are formed at free ends of the securing bars, the two hook bodies being plugged in the central passage of the tension rod and the hook bodies at the free ends being hooked in respective engagement holes of the tension rod and connected therewith.

2. The free hanging safety bead chain tension device as claimed in claim 1, wherein the more than one restriction tunnel of each of the more than one restriction seat have a diameter large enough whereby different sizes of bead chains, positioning stop beads and connectors can successfully pass through each said more than one restriction tunnel to allow operation.

3. The free hanging safety bead chain tension device as claimed in claim 1, wherein a hanging hook is fitted on the upper ring member secured to the upper end of the tension rod, the hanging hook being disposed between the bead chain and a bracket, the bead chain and the bracket being assembled with each other, whereby the hanging hook is securely sandwiched between the bead chain and the bracket and the tension rod can be hung on the hanging hook.

4. The free hanging safety bead chain tension device as claimed in claim 3, wherein an upper end of the hanging hook is formed with a fitting ring, a lower end of the fitting ring being formed with a split, two extending bars extend downwardly from the split, two ring bodies being respectively formed at free ends of the extending bars, the upper ring member being hooked and hung on the ring bodies and connected therewith, whereby the upper ring member is free to sway and move on the hanging hook.

5. The free hanging safety bead chain tension device as claimed in claim 1, wherein the engagement holes are formed on an inner wall of the central passage of the tension rod, the hook bodies of the upper ring member and the lower ring member being correspondingly engaged in the engagement holes.

6. The free hanging safety bead chain tension device as claimed in claim 1, wherein a respective slot is formed between the more than one restriction tunnel and the seat passage of each of the more than one restriction seat in communication with the restriction tunnel and the seat passage, whereby the bead chain can pass through each of the more than one restriction seat.

7. The free hanging safety bead chain tension device as claimed in claim 1, wherein each of the more than one restriction seat are secured on the rod body of the tension rod, each of the more than one restriction seat being formed with the more than one restriction tunnel, whereby the bead chain can pass through each said more than one restriction tunnel to be disposed adjacent to the tension rod.

* * * * *